United States Patent [19]

Yamashita et al.

[11] Patent Number: 4,958,199

[45] Date of Patent: Sep. 18, 1990

[54] PRINTING APPARATUS WITH REGISTRATION POSITIONING PLATE

[75] Inventors: Hideaki Yamashita; Tadashi Hayamizu; Kiichiro Tanaka, all of Fukuoka, Japan

[73] Assignee: Matsushita Electric Industrial Co., Ltd., Kadoma, Japan

[21] Appl. No.: 259,825

[22] Filed: Oct. 19, 1988

[30] Foreign Application Priority Data

Oct. 20, 1987 [JP] Japan ..... 62-264478

[51] Int. Cl.[5] ..... G03G 21/00

[52] U.S. Cl. ..... 355/317; 271/245; 355/309

[58] Field of Search ..... 271/245, 246, 266, 229, 271/230, 234; 355/308, 317, 309

[56] References Cited

U.S. PATENT DOCUMENTS

| | | | |
|---|---|---|---|
| 3,781,004 | 12/1973 | Buddendeck et al. | 271/245 X |
| 4,025,187 | 5/1977 | Taylor et al. | 271/245 X |
| 4,037,535 | 7/1977 | Lehmann et al. | 271/245 X |
| 4,135,804 | 1/1979 | Schoppe et al. | 271/245 X |

*Primary Examiner*—A. T. Grimley
*Assistant Examiner*—Robert Beatty

[57] ABSTRACT

A printing apparatus having a paper positioning plate swingably supported and having two positions in operation. The first position temporarily stops the carrying of an edge of a paper sheet by engaging the edge. The second position allows the paper sheet to be freely carried. The portion of the paper positioning plate which engages the edge of the paper sheet is curved as an arc having its axis on the axis of swing of the paper positioning plate. Thus, the swinging motion of the paper positioning plate does not create a strong frictional force at the edge of the sheet of paper and hence no paper particles are produced.

2 Claims, 4 Drawing Sheets

PRINTING APPARATUS WITH REGISTRATION POSITIONING PLATE

FIELD OF THE INVENTION AND RELATED ART

1. Field of the Invention

The present invention relates to a printing apparatus usable for printing images by utilizing xerographic technology.

2. Description of the Related Art

In recent years, a printing apparatus has been used usually in order to obtain a clear recording on paper. The printing apparatus utilizes electrophotography to produce a copy on a sheet. It is a method in which an electrostatic latent image is formed on a surface of a photoconductor drum and developed by applying toner particles, and then the developed image is fixed on a paper after transferring thereto.

FIG. 3 and FIG. 4 are side views of conventional printing apparatus. The conventional printing apparatus is constituted as follows; Cassettes 1*a*, 1*b* for containing paper sheets 2*a*, 2*b* are mounted on a frame 22. Semicircular rollers 3*a*, 3*b* for supplying a sheet of paper 21 one by one are provided on the frame 22. Pairs of rollers 4*a*, 4*b*, 4*c* for carrying the sheet of paper 21 are provided on the frame 22. Shoots 5*a*, 5*b*, 5*c* for guiding the sheet of paper 21 are mounted on the frame 22. A gate 6 has a pin 6*a* and a paper-positioning plate 6*b*. The gate 6 can be swung around an shaft 9 by which it is supported on the frame 22. The gate 6 can be placed at either position to obstruct carrying of the paper sheet 21 or not to obstruct. A photoconductor drum 7 rotating in the direction of the arrow A is mounted on the frame 22. Toner 8 is stuck on a surface of the photoconductor drum 7. A link 10 for connecting the pin 6*a* and a plunger 12 is swingingly supported by a torsion coil spring 11 the pin 6*a*. The torsion coil spring 11 holds the link 10 down in the direction of the arrow B. The plunger 12 for making the link 10 swing to the opposite direction of the arrow B is supported on the frame 22.

The operation of the above-mentioned conventional printing apparatus is elucidated hereinafter. For instance, at the selection of upper cassette 1*a*, the semicircular roller 3*a* takes out a sheet of paper 21 one by one from the cassette 1*a*. The supplying pair of rollers 4*a* carries the paper sheet 21 along the shoot 5*a*. When the edge of the paper sheet 21 touches the paper-positioning plate 6*b* of the gate 6, the supplying pairs of rollers 4*a*, 4*b* come to a halt to adjust a printing position of the paper sheet 21 to an electrostatic latent image formed on the photoconductor drum 7. After the above-mentioned adjusting, an operation of the plunger 12 spaces the paper-positioning plate 6*b* from the edge of the paper sheet 21, thereby the paper sheet 21 again can be carried freely. After subsequent known steps of transcription and thermal fixing, printing on the paper sheet 21 is carried out.

In the above-mentioned related art, different positions such as C,D or E (in FIG. 4) of the paper sheet 21 touching the paper-positionig plate 6*b* cause bending of front edge of the paper sheet 21 by swinging of the paper-positioning plate 6*b*. In the conventional apparatus, there is a problem that the bending resulting in a jamming of the paper sheet 21. Further, the swinging of the paper-positioning plate 6*b* which causes the bending of the front edge of the paper sheet 21 induces a strong friction between front edge of the paper sheet 21 and the paper-positioning plate 6*b*, with jostling to each other. It increases the undersirable production of paper particles, which adhere on the surface of the photoconducdtor drum 7 and decrease printing quality.

OBJECT AND SUMMARY OF THE INVENTION

Object of the present invention is to provide an improved printing apparatus capable of solving the above-mentioned conventional disadvantage, wherein bending of a edge of paper sheet is caused which bending results in paper jamming and production of paper particles.

This and other objects are accomplished by an printing apparatus which comprises;

(A) a photoconductor drum;

(B) carrying means for carrying a recording medium by frictional force to the photoconductor drum in relation to rotation of the photoconductor drum; and (C) a paper-positioning plate which is movably supported to have two positions, a first position being that which temporarily stops to carrying of the recording medium for position alignment by touching the edge of the recording medium and a second position being that which allows carrying freely of the recording medium, touching part of the papar-positioning plate to the recording medium is shaped in a partial cylindrical face with its axis on the axis of swing of the paper-positioning plate.

Since the printing apparatus in accordance with the present invention is constituted as mentioned above, a sectional shape of the paper-positioning plate is shaped in a circular arc with its axis on the axis of a shaft of the swingable gate in the invention, thereby the paper-positioning plate never applies such a force to cause a bending of the edge of the paper sheet that results in a jam of the paper sheet. In addition to that, since the swing of the paper-positioning plate does not create a strong frictional force between the paper sheet and the paper-positioning plate with jostling one another, it does not produce paper particles nor worsen the quality of printing such as by the conventional adherence of paper particles on the surface of the photoconductor drum.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Figure 1:
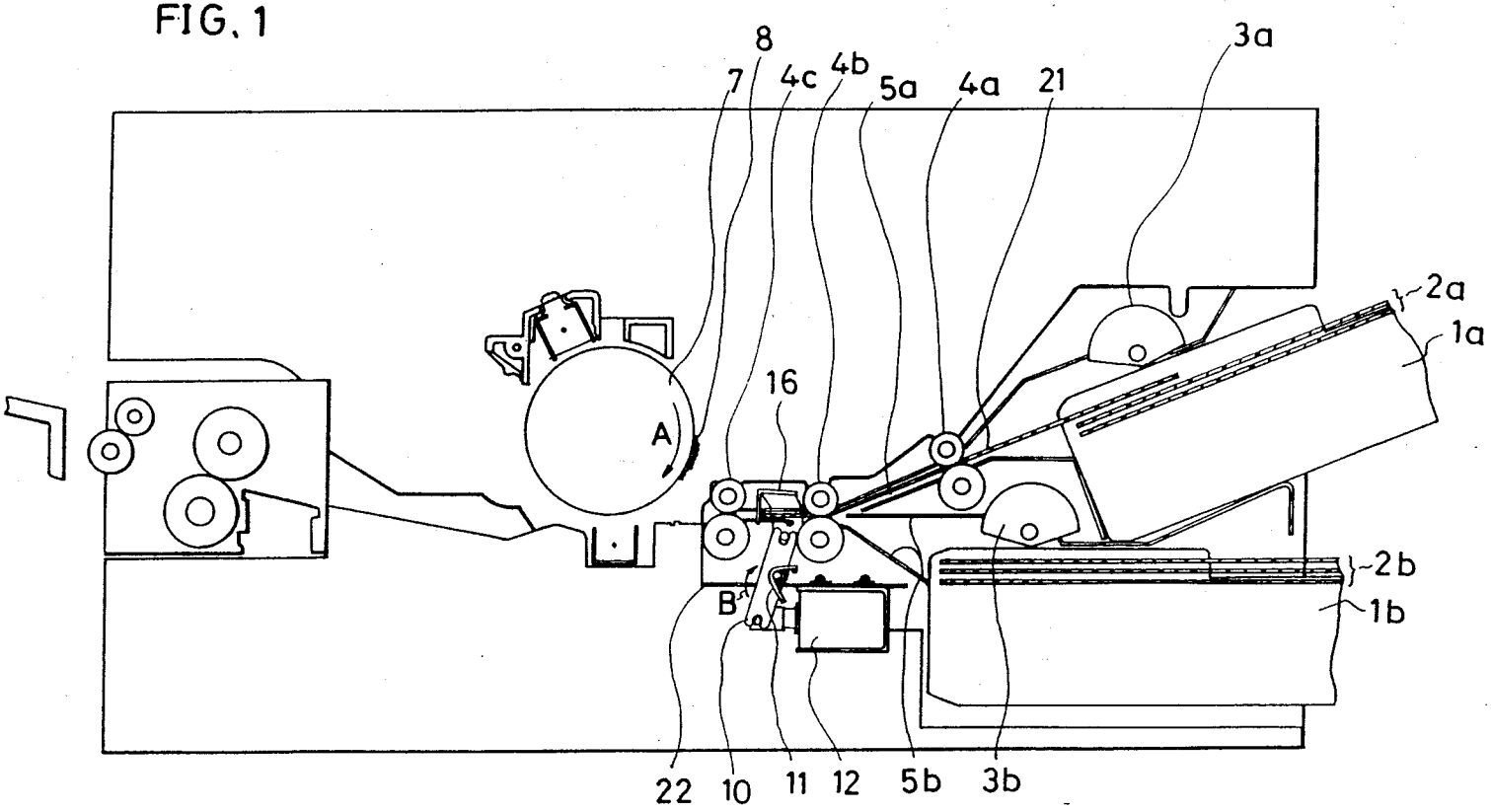
FIG. 1 is an internal side view of a preferred embodiment of an printing apparatus in accordance with the present invention.
Figure 2:
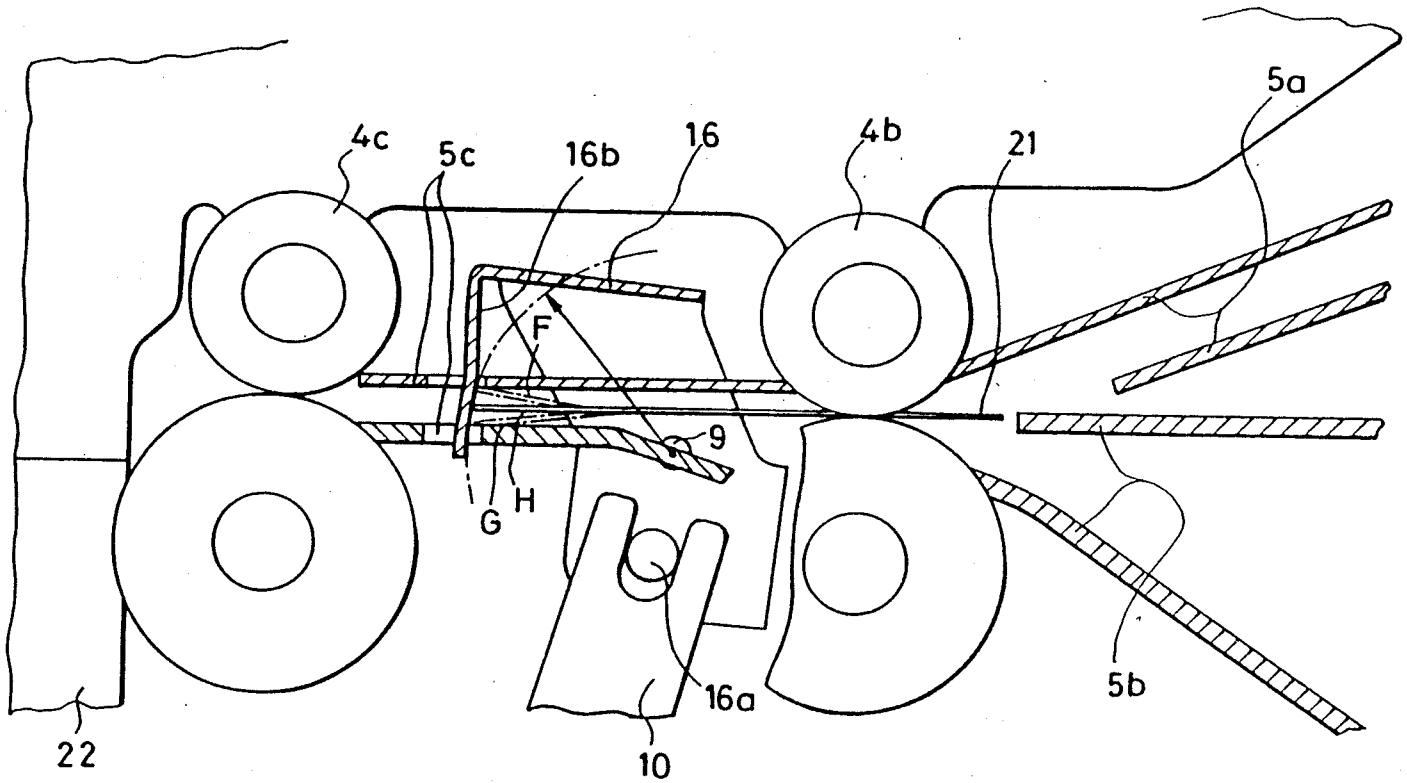
FIG. 2 is an enlarged view of the main constitution in FIG. 1.
Figure 3:
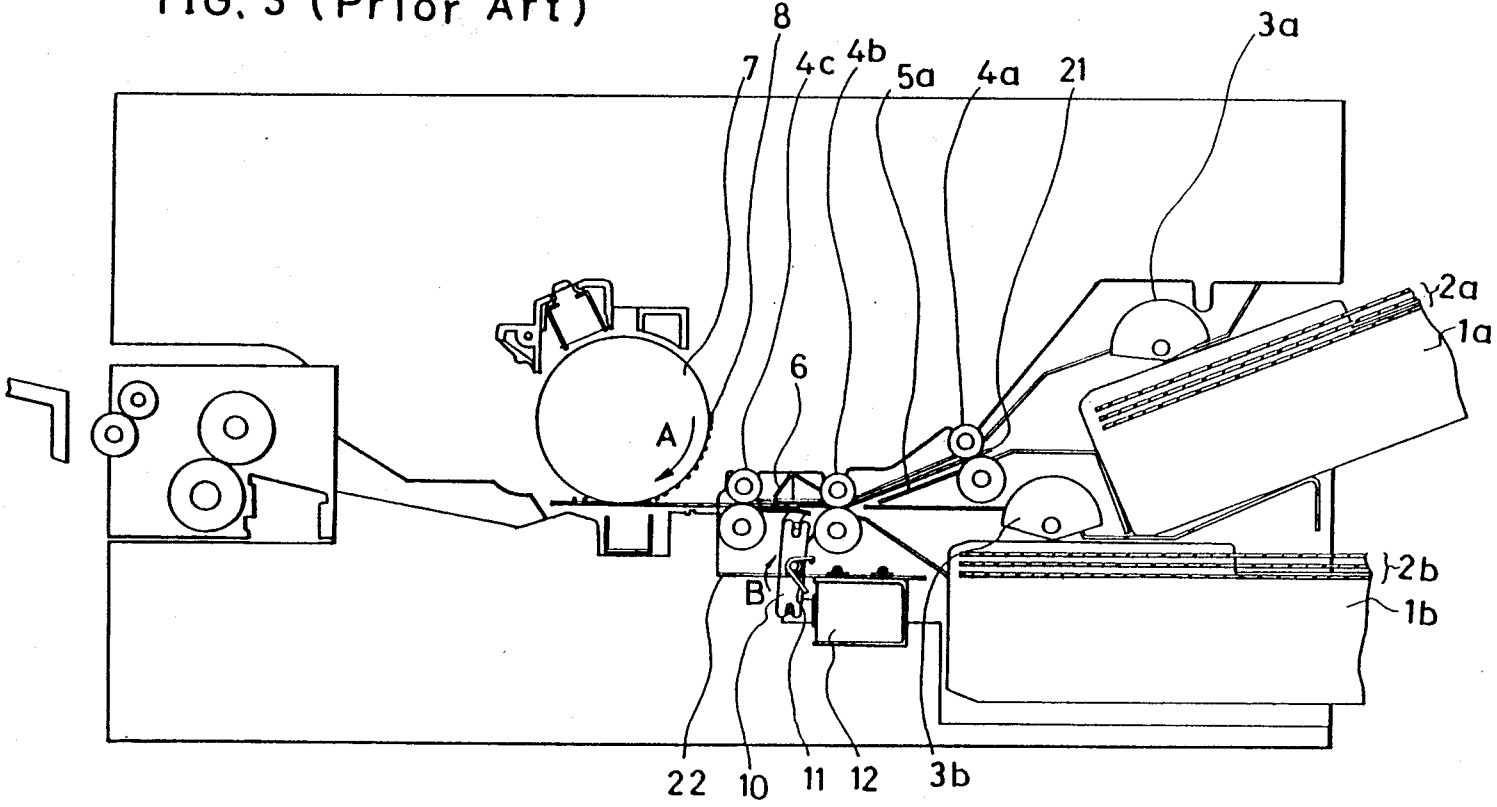
FIG. 3 (Prior Art)
FIG. 3 is an internal side view of a conventional Printing apparatus.
Figure 4:
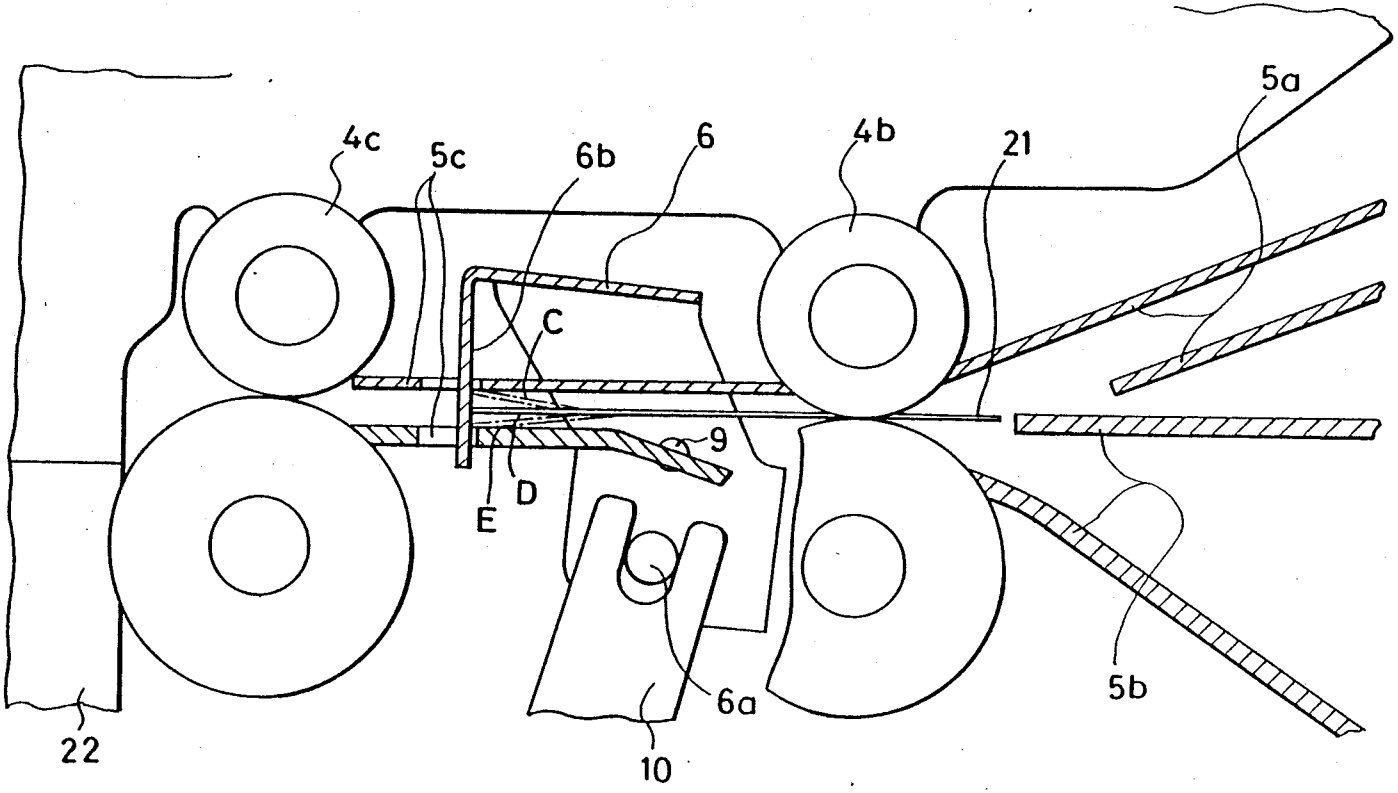
FIG. 4 (Prior Art)
FIG. 4 is an enlarged view of the main constitution in FIG. 3.

A preferred embodiment of an printing apparatus is described in reference to FIG. 1 and FIG. 2

FIG. 1 is a side view of an printing apparatus in accordance with the present invention. FIG. 2 is an enlarged view of the main constitution in FIG. 1. The printing apparatus is constituted as following; Cassettes 1a, 1b for containing paper sheets 2a, 2b are mounted on a frame 22. Semicircular rollers 3a, 3b for supplying a sheet of paper 21 one by one are provided on the frame 22. Pairs of rollers 4a, 4b, 4c for carrying the paper sheet 21 are provided on the frame 22. Shoots 5a, 5b, 5c for guiding the paper sheet 21 are mounted on the frame 22. A gate 16 has a pin 16a and a paper-positioning plate 16b. The gate 16 can be swung around an shaft 9 by which it is supported on the frame 22. The gate 16 can be placed at the either position to obstruct carrying the paper sheet 21 or not to obstruct. An inner surface of the paper-positioning plate 16b, to which surface the edge of the paper sheet about, is shaped in a partial cylindrical face with its axis on the axis of shaft 9 of the swingable gate 16. A photoconductor drum 7 rotating to the direction of the arrow A is mounted on the frame 22. Toner 8 is stuck on a surface of the photoconductor drum 7. A link 10 connected to the pin 16a is supported. Thereby the link 10 can be swung around. A torsion coil spring 11 holds the link 10 down to the direction of the arrow B. A plunger 12 for making the link 10 swing to the opposite direction of the arrow B is supported on the frame 22.

The operation of the above-mentioned preferred embodiment of an printing apparatus is elucidated hereinafter. For instance, at the selection of upper cassette 1a, the semicircular roller 3a takes out a sheet of paper one by one from the cassette 1a. The supplying roller 4a carries the paper sheet 21 along the shoot 5a. When the edge of the paper sheet 21 touches the paper-positioning plate 16b of the gate 16, the supplying pairs of rollers 4a, 4b come to temporarily halt the paper sheet to obtain an accurate printing position of the paper sheet 21 to an electrostatic latent image formed on the photoconductor drum 7. After the above-mentioned adjusting, an operation of the plunger 12 makes the paper-positioning plate 16b part from the edge of the paper sheet 21, thereby the paper sheet 21 again can be carried freely. Thereafter, known steps of transcription and thermal fixing are carried out on the paper sheet 21.

According to the present invention a sectional shape of the paper-positioning plate 16b is made an arc with its center at the same point as a center of the swingable gate 16 as in the embodiment, and thereby no matter how the position of the paper sheet 21 varies in the shoot 5c such as F, G or H in FIG. 2, the paper-positioning plate 16b never applies a force to cause such a bending of an edge of the paper sheet 21 as to result in a jam of the paper sheet 21. In addition thereto, the swing of the paper-positioning plate 16b does not create a strong frictional force between the paper sheet 21 and the paper-positioning plate 16b, with jostling to each other. Thereby, there is no fear of producing paper particles by swinging of the paper-positioning plate nor worsening of quality of printing from adherence of paper particles to the surface of the photoconductor drum 7.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed Is:

1. A printing apparatus comprising:

(A) a photoconductor;

(B) carrying means for carrying a recording medium by frictional force to said photoconductor in relation to rotation of said photoconductor; and (C) a positioning plate which is supported to be shifted by a plunger between two positions; a first position being that which temporarily stops carrying of said recording medium for position alignment by touching the edge of said recording medium and a second position being that which allows carrying freely of said recording medium, a touching part of said positioning plate to said recording medium is curved as an arc having its axis on the axis of swing of said positioning plate.

2. A printing apparatus comprising:

(A) a photoconductor;

(B) a guide for guiding a recording medium to a position facing said photoconductor;

(C) carrying means for carrying said recording medium by frictional force to said photoconductor in relation to rotation of said photoconducdtor; and (D) a positioning plate which is supported to be shifted by a plunger between two positions; a first position being that which temporarily stops carrying of said recording medium for position alignment by touching the edge of said recording medium and a second position being that which allows carrying freely of said recording medium, a touching part of said positioning plate to said recording medium is curved as an arc having its axis of swing of said positioning plate.

* * * * *